United States Patent [19]

Dixon

[11] 4,141,106

[45] Feb. 27, 1979

[54] MULTI-DIRECTIONAL CANTED WHEEL CARRIER FOR OPERABLE WALLS

[75] Inventor: Guy E. Dixon, Miami, Fla.

[73] Assignee: Panelfold, Inc., Miami, Fla.

[21] Appl. No.: 847,036

[22] Filed: Oct. 28, 1977

[51] Int. Cl.[2] ..... A47H 15/00; E05D 13/02

[52] U.S. Cl. ..... 16/89; 16/95 R; 16/104; 16/106; 16/107

[58] Field of Search ..... 16/87 R, 86.1, 87 B, 16/87.4 R, 87.8, 94, 96 R, 105, 107, 97, 104, 106, 100, 89; 49/409, 410, 411, 425, 426, 427, 231, 235; 160/19, 123

[56] References Cited

U.S. PATENT DOCUMENTS

| | | | |
|---|---|---|---|
| 941,664 | 11/1909 | Thompson | 16/18 A |
| 2,523,935 | 9/1950 | Austin | 16/89 |
| 2,773,357 | 12/1956 | Canter | 16/18 A |
| 3,042,960 | 7/1962 | Spork | 16/105 |
| 3,813,728 | 6/1974 | Johnson | 16/105 |
| 3,879,799 | 4/1975 | Williams | 16/104 |

FOREIGN PATENT DOCUMENTS

| | | | |
|---|---|---|---|
| 294683 | 6/1967 | Australia | 49/235 |

*Primary Examiner*—Ronald Feldbaum
*Attorney, Agent, or Firm*—Clarence A. O'Brien; Harvey B. Jacobson

[57] ABSTRACT

A canted wheel carrier for supporting operable wall panels from upper and/or lower supporting surfaces to enable multi-directional movement of the panels and facilitate negotiation of angle turns and intersections without switches or curves in the supporting surfaces with a minimum of frictional resistance thereby reducing the force which must be applied to the panels to move them to a desired location and reducing frictional wear. The invention includes a top or bottom canted wheel carrier with or without a guide member or with a single or multiple canted wheels which engage a top or bottom supporting surface.

32 Claims, 25 Drawing Figures

MULTI-DIRECTIONAL CANTED WHEEL CARRIER FOR OPERABLE WALLS

BACKGROUND OF THE INVENTION

1. Field of the Invention

The present invention generally relates to supporting carriers for movably supporting operable wall panels from a supporting surface or surfaces and more particularly a carrier having a canted wheel or wheels supportingly engaging a supporting surface or surfaces to enable the carrier and the panel to be moved in any direction along the supporting surface and enabling negotiation of angle turns or intersections in the supporting surface without switching devices or curved supporting surfaces.

2. Description of the Prior Art

Operable wall systems that are top and/or bottom supported have been developed utilizing a trackway system which involves a generally channel-shaped track having inwardly extending flanges having adjacent edges in spaced parallel relation to provide a track slot or groove. A carrier or plurality of carriers is movably positioned in the track with a supporting element extending through the track slot for supporting a wall module, panel, or the like, to enable the module to be moved to a desired location in relation to an enclosed space thereby defining a wall, partition, or the like. In order to relocate the wall or store the modules in a compact, stacked position, the supporting tracks are provided with curved sections in some instances and in some instances provided with switching devices, both of which facilitate rolling movement of the track engaging rollers mounted on the carrier in the track, since these rollers normally rotate on a horizontal axis parallel with the track flanges. There has also been developed a slide disk-type or "puck" carrier for top supported operable walls which includes a generally circular disk disposed in the track in engagement with the track flanges and bridging the track slot with the disk including a central depending support member connected with the wall module or panel. This type of structure enables negotiation of angle turns or intersections in the track and enables the modules to be placed in any desired position in a trackway grid system. The disk-type carrier produces substantial frictional engagement with the track flanges and substantial force is required to move the wall modules along the track and substantial force is required to negotiate an angle turn in the track.

There has also been developed a carrier for top supported operable walls in which the overhead track includes vertically spaced and opposed flanges with the carrier including vertically spaced wheels or rollers on a common vertical support axle or spindle which depends from the track for supporting a wall panel. The vertically spaced and aligned supporting wheels or rollers engage vertically spaced flanges on opposite sides of the track slot with the rollers or wheels being independently rotatable so that as the carrier moves along the track, one roller or wheel will rotate in one direction and the other roller or wheel will rotate in the other direction. Prior U.S. Pat. Nos. 3,042,960, issued July 10, 1962, and 3,879,799, issued Apr. 29, 1975, disclose this type of supporting carrier which reduces the frictional resistance to movement but introduces the necessity of a track configuration having substantial depth and requires accurate manufacturing techniques in order to provide the appropriate relationship between the vertically spaced wheels and the vertically spaced track flanges. The tracks disclosed in the above patents require accurate cutting and matching of mitered corners, that is, by abutting the correct ends of the track sections since the configuration is non-symmetrical. Also, when installing the track, great care must be taken to accurately align the vertically offset flanges. Even when the vertically offset flanges have been properly aligned and matched, the panels will drop when the supporting wheels traverse an intersection or angle turn as the supporting wheels move in a diagonal path across an intersection or angle turn and drop into the valley or trough defined by the mitered joint between the track surfaces. Also, the direction of rotation of the supporting wheels will change when proceeding through a three-way intersection.

SUMMARY OF THE INVENTION

An object of the present invention is to provide a multi-directional canted wheel carrier for a top or bottom supported operable wall system in which the rotational axis of the canted wheel is inclined or canted and the plane of rotation of the wheel is inclined or canted whereby a portion of the peripheral axial surface of the canted wheel will rollingly engage a supporting surface and the diametrically opposite portion of the wheel will be spaced from the supporting surface with the carrier including support means connected with a panel for facilitating movement of the panel during negotiation of angle turns of the carrier in relation to the supporting surface.

Another object of the invention is to provide a canted wheel carrier in accordance with the preceding object in which the supporting surface is in the form of a trackway and the carrier is provided with a single canted wheel having a portion of a peripheral axial surface engaged with the supporting surface.

A further object of the invention is to provide a canted wheel carrier in which the carrier is provided with a single canted wheel having a trailing or leading plate and guide member in the form of a stud or roller received in the track slot in longitudinally spaced relation to the wheel to guide and control movement of the canted wheel in relation to the track to facilitate negotiation of angle turns.

Still another object of the invention is to provide a canted wheel carrier in which the carrier is provided with two canted wheels oriented in tandem relation and spaced longitudinally along the track with one wheel being canted in one angular direction and the other wheel being canted in the opposite angular direction in relation to a vertical plane.

A still further object of the present invention is to provide a canted wheel carrier for a modular operable wall system, partition panels, or the like, in which the carrier is provided with vertically stacked canted wheels, either a single pair or tandem pairs, engaging a supporting surface with vertically spaced flanges.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
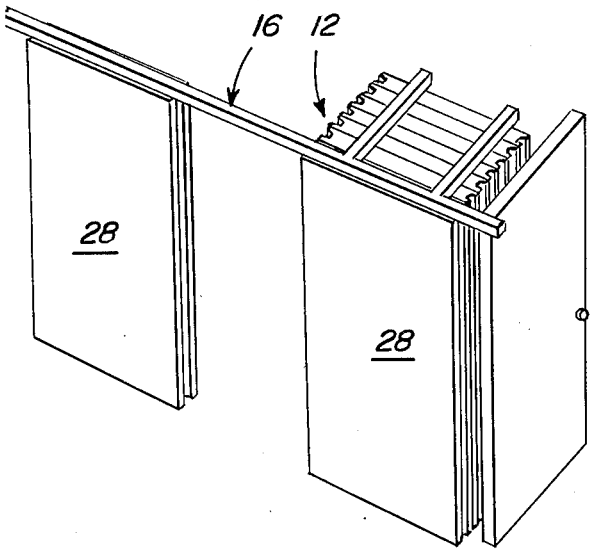
FIG. 1 is a schematic perspective view of an operable wall system illustrating a track arrangement facilitating the stacking of wall panels in a compact, stored condition.
Figure 3:
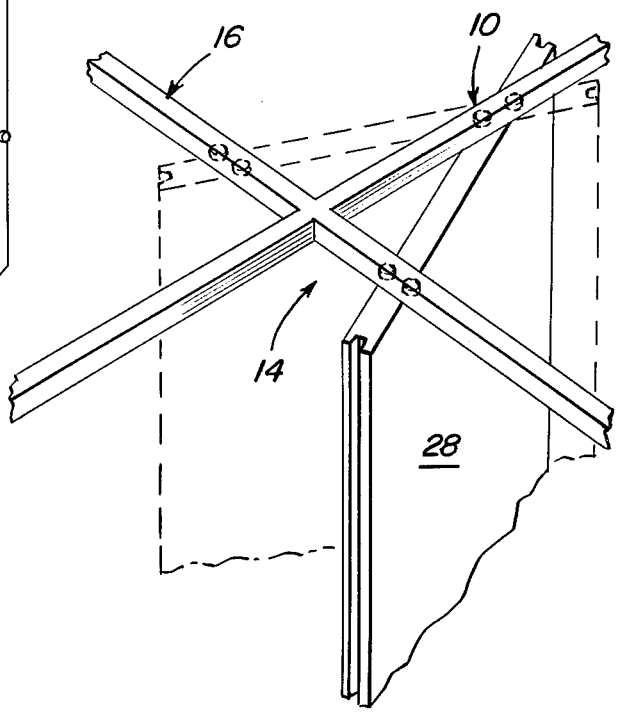
FIG. 3 is a schematic perspective view illustrating intersecting tracks in an overhead grid track system illustrating the manner in which wall modules or panels can be negotiated in relation to the intersection.
Figure 2:
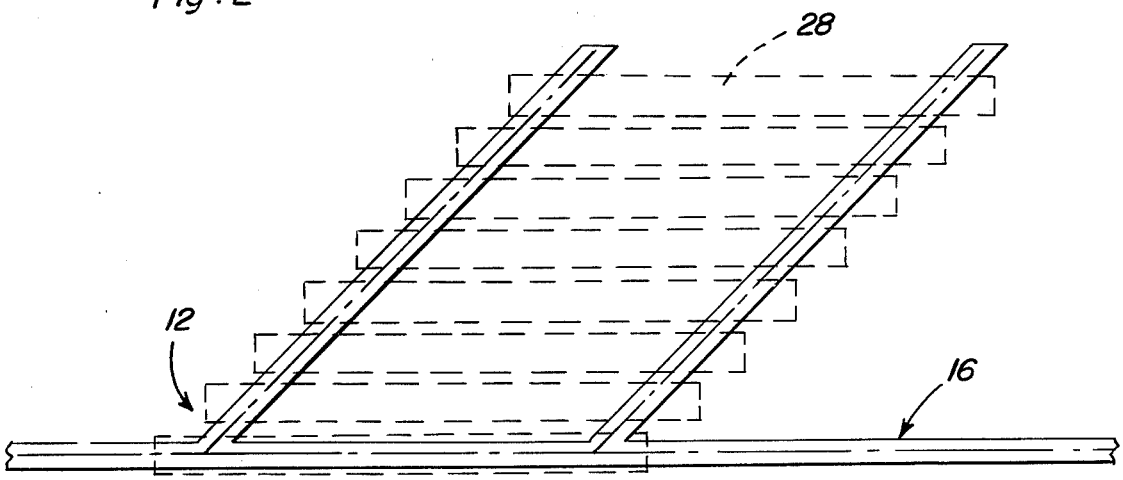
FIG. 2 is a schematic plan view illustrating another track arrangement for stacking wall panels.
Figure 4:
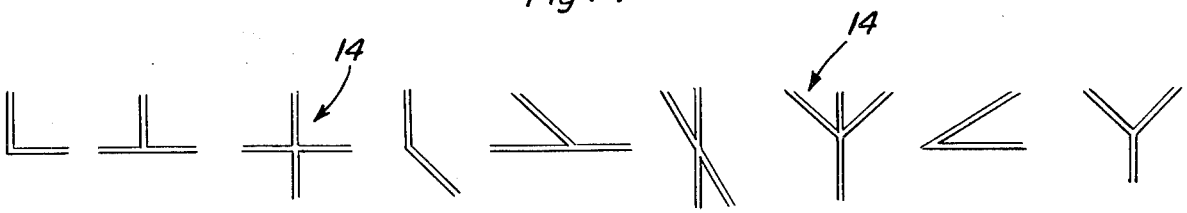
FIG. 4 is a group of diagrammatic views showing alternative track intersection arrangements.

Referring now specifically to FIGS. 1-4, the canted wheel carrier of this invention is generally designated by numeral 10 and is illustrated schematically in association with a track system having a panel stacking arrangement 12, with FIGS. 1 and 2 illustrating two of many possible stacking arrangements. The carrier may also be used with a grid track system 14 incorporating various angle turns and intersections, such as those shown in FIGS. 3 and 4.

In the track systems 12 and 14, angular paths of movement are provided and in the grid system 14, intersecting tracks are provided to enable suspended wall modules or panels 28 to be moved longitudinally of the track system or laterally thereof into storage tracks or to negotiate a right angle or other angle turn which may be either a cross-type intersection, a T-intersection or any angle intersection with each module or panel 28 being supported by one or more carriers 10. The track systems 12 and 14 and the track 16 are of conventional and well-known structure and the modules or panels 28 are also conventional components.

Figure 5:
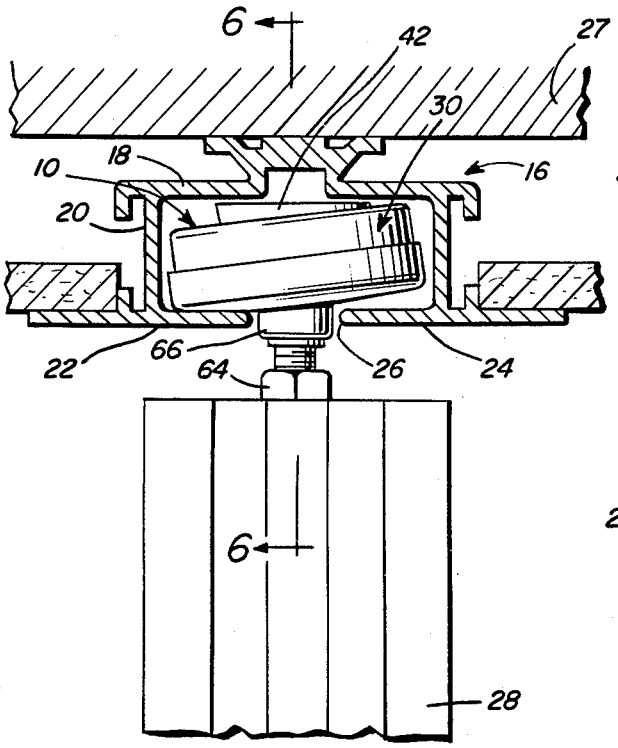
FIG. 5 is a transverse, sectional view of a channel-shaped top track illustrating, in elevation, a top single canted wheel carrier.
Figure 6:
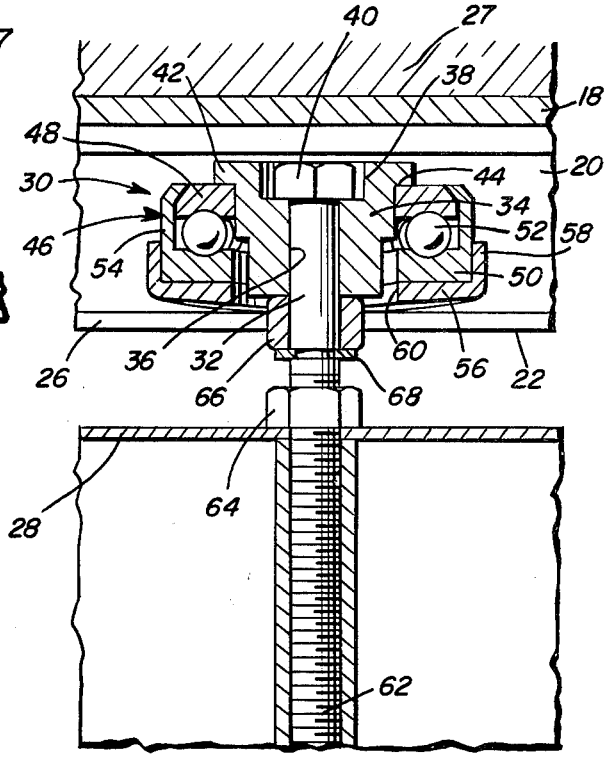
FIG. 6 is a longitudinal, sectional view taken substantially upon a plane passing along section line 6—6 of FIG. 5 illustrating further structural details of this embodiment of the invention.

The track system in FIGS. 5 and 6 includes a generally channel-shaped track 16 including a horizontal web 18 and depending side walls 20 terminating in inwardly extending track flanges 22 and 24 having spaced parallel facing edges defining a track slot 26. The channel-shaped track 16 is supported in any suitable manner from an overhead support structure 27 so that the track 16 can be supported in a level condition.

FIGS. 5 and 6 of the drawings illustrate an embodiment of the canted wheel carrier 10 of the present invention which includes a single canted wheel 30 received in the track 16 which supports a panel 28 by a bolt 32 forming a vertical axle or spindle for the canted wheel 30.

The canted wheel 30 includes a tilt body 34 having a bore 36 extending therethrough with the upper end of the tilt body 34 including a recess 38 communicating with the bore 36 and receiving the head 40 of the bolt 32. The upper end portion of the tilt body 34 also includes a peripheral flange 42 peripherally thereof with one side of the flange 42 being thicker than the other thus providing a downwardly facing inclined shoulder 44 which is engaged by a wheel generally designated by numeral 46 in the form of a thrust bearing having upper and lower races 48 and 50 with ball bearings 52 therebetween with the periphery of the lower race 50 extending upwardly in enclosing relation to the ball bearings 52 and the periphery of the upper race 48 as indicated by numeral 54. In view of the inclined or canted nature of the wheel 46, the rotational axes of the lower race 50 is inclined in relation to vertical. The lower race 50 is provided with a cap 56 underlying the lower race and including an upturned flange 58 which encloses a portion of the periphery of the lower race 50 as illustrated in FIG. 6. The thrust bearing assembly 46 includes a lower open end 60 which receives the lower end of the tilt body 34 with the bolt 32 depending vertically through the bore 36 and extending downwardly through the track slot 26 and provided with a screw threaded connection 62 with the supported wall panel 28. A retaining and adjusting nut 64 is provided on the screw threaded portion 62 of the bolt 32 for adjusting the position of the panel 28.

A roller 66 is journaled on the bolt 32 and is disposed in the track slot 26 below the tilt body 34 and is retained in position thereon by a split spring ring 68 received in a groove in the bolt 32 for retaining the carrier 10 in assembled relation with the roller 66 maintaining the carrier centralized and rollingly contacting the edges of the slot 26. The bolt 32 and tilt body 34 are interconnected in a manner to preclude relative rotation therebetween so that the relationship of the tilt body 34 will be maintained whereby the same axial surface portion of the canted wheel 30 will engage the track flange 22 as illustrated in FIG. 5, thus reducing friction and wear and facilitating negotiation of angle turns, intersections, or the like.

Figure 7:
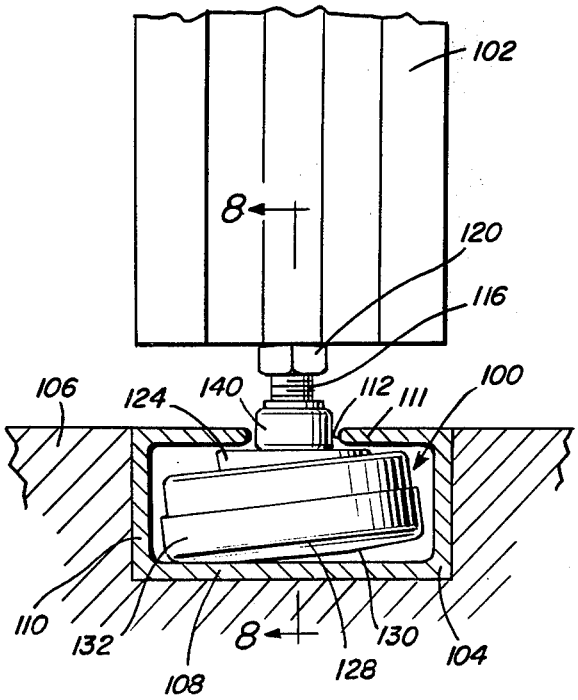
FIG. 7 is a transverse sectional view of a bottom track illustrating, in elevation, a bottom single canted wheel carrier.
Figure 8:
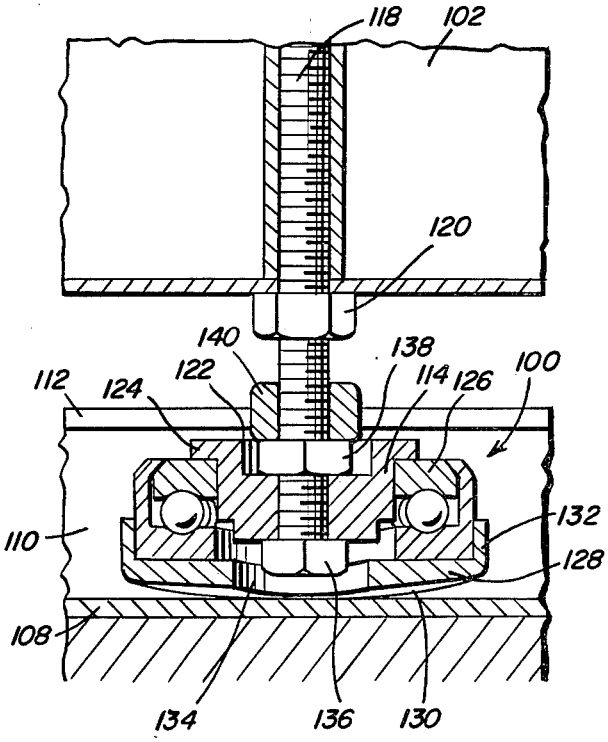
FIG. 8 is a longitudinal, sectional view taken substantially upon a plane passing along section line 8—8 of FIG. 7 illustrating further structural details of the bottom canted wheel carrier.

FIGS. 7 and 8 disclose a bottom canted wheel carrier generally designated by numeral 100 which supports a wall module 102 from a bottom track 104 which may be embedded in or recessed in a floor surface 106. The track 104 includes a bottom wall or web 108, upstanding side walls or flanges 110 and inturned top flanges 111 which terminate in spaced relation to define a longitudinal track slot 112.

The carrier 100 includes a tilt body 114 disposed interiorly of the track 104 which is supported on a supporting bolt 116 which extends through the track slot 112 and is connected to the wall module 102 by a threaded portion 118 and nut 120. The tilt body 114 is mounted on the bolt 116 as illustrated in FIG. 8 for transmitting the load of the wall module 102 to the tilt body 114. The tilt body 114 includes a flange 124 engaging the upper surface of a ball bearing assembly 126 which has the lower end thereof received in a cap 128. The cap 128 is provided with an inclined lower surface 130 and a peripheral flange 132 which is engaged with the bearing 126. The center of the cap 128 may be solid or provided with an opening 134, as illustrated in FIG. 8, to provide access to the head 136 on the bolt 116 which retains the tilt body and thus the bearing and cap assembled on the supporting bolt 116. This structure is substantially the same as that illustrated in FIGS. 5 and 6 except that the bolt extends upwardly in relation to the bottom track with the load of the wall module being supported by the rolling contact between a portion of the peripheral axial surface of the carrier wheel on the bottom surface 108 of the track 104. The bolt 116 is provided with a flange or nut 138 thereon engaged with the recess 122 in the tilt body and a roller 140 engages the nut or flange 138 and is disposed in the track slot 112 for rolling contact with either edge of the track slot in order to maintain the wheel generally in the center of the track 104 and to prevent radial contact between the radial peripheral surface of the canted wheel and the track.

Figure 9:
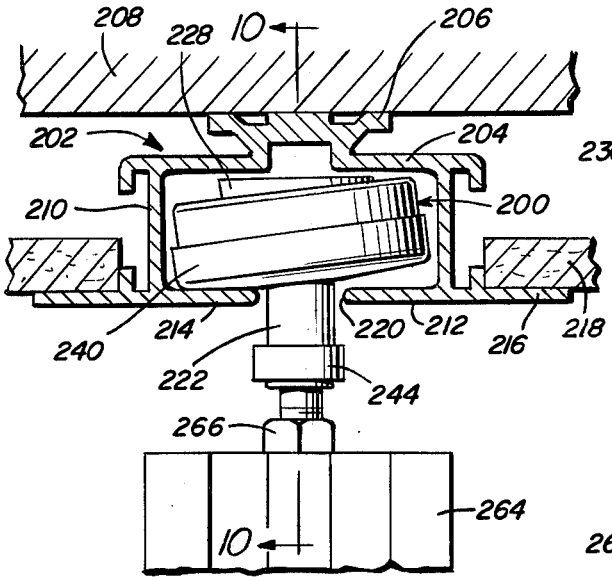
FIG. 9 is a transverse, sectional view similar to FIG. 5 illustrating a carrier having a single canted wheel with a trailing plate and stud received in the track slot.
Figure 10:
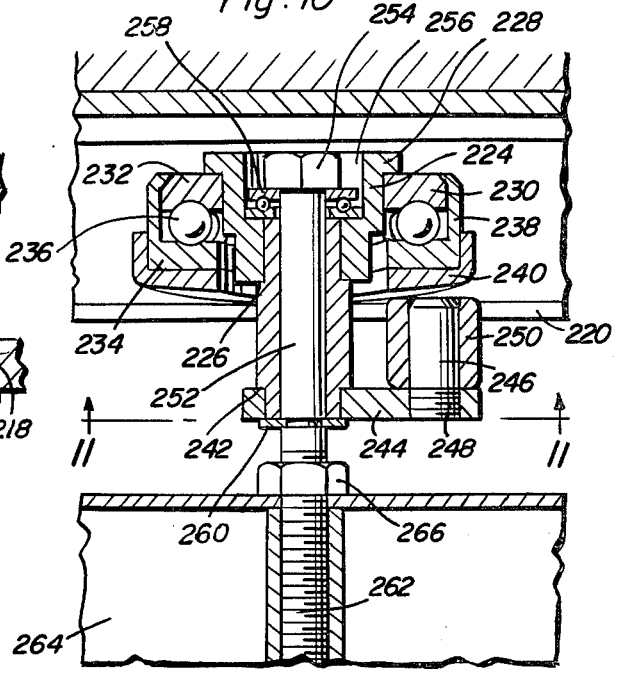
FIG. 10 is a longitudinal, sectional view taken substantially upon a plane passing along section line 10—10 of FIG. 9 illustrating further structural details of this embodiment of the invention.
Figure 11:
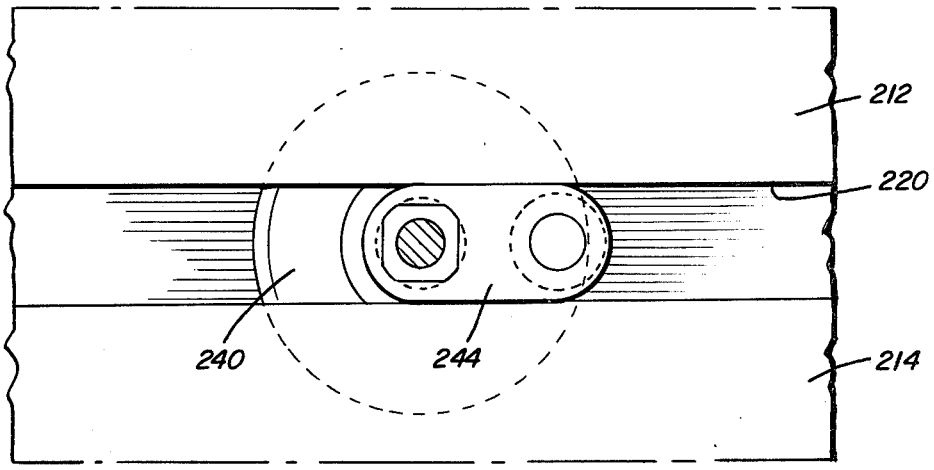
FIG. 11 is a bottom view taken substantially upon section line 11—11 of FIG. 10 illustrating the relationship of the canted wheel, trailing plate and stud received in the track slot.

FIGS. 9–14 illustrate an embodiment of the carrier generally designated by numeral 200 which is illustrated in association with a track 202 which is also generally channel-shaped and includes a top wall or web 204 having a mounting bracket 206 associated therewith for supporting engagement with an overhead support 208. The web 204 includes depending walls 210 terminating in inwardly extending flanges 212 and 214 and also outwardly extending flanges 216 for supporting a ceiling panel 218, or the like. The flanges 212 and 214 terminate in spaced relation to provide a track slot 220 through which extends a generally cylindrical connector bushing 222 having a slightly reduced upper end on which is mounted a cylindrical body 224 rigid therewith and resting against a centrally located shoulder 226 on the connector bushing 222. The upper end of the body 224 includes a peripheral external flange 228 defining a downwardly facing shoulder against which a thrust bearing 230 engages. The thrust bearing 230 may be of the ball type with the upper race 232 being separated from the lower race 234 by a plurality of spherical ball bearings 236 with the lower race 234 including a peripheral flange 238 enclosing the ball bearings to maintain lubrication therein and exclude dirt and dust. The thrust bearing assembly 230 may be a conventional thrust bearing with the lower race thereof including a covering or cap 240 of self-lubricating plastic material, such as nylon, or the like, for engagement with the upper surface of the track flange 214, as illustrated in FIG. 9. As illustrated, the connector bushing 222 is vertically disposed through the track slot 220 with the body 224 being tilted in relation to the vertical disposition of the bushing 222 so that the thrust bearing 230 is also tilted. The thrust bearing 230 and cap 240 define a canted wheel with only a small peripheral axial portion of the cap 240 engaging the track flange 214.

The lower end of the connector bushing is reduced to define a downwardly facing shoulder 242. Mounted on the lower end of the connector bushing 222 is a longitudinally extending plate or control arm 244 engaging the end portion of the bushing 222 and abutted against the shoulder 242. The plate 244 extends longitudinally below the track flanges 212 and 214 and the end portion thereof remote from the bushing 222 is provided with an upwardly extending stud 246 screw threaded into the plate 244 by screw threaded connection 248. The stud extends up into the track slot 220 and rotatably journals a roller 250 thereon with the roller 250 being disposed in the track slot so that the plate 244 oriented in trailing relation to the canted wheel will retain the plate 244 in alignment with the track slot.

Figure 12:
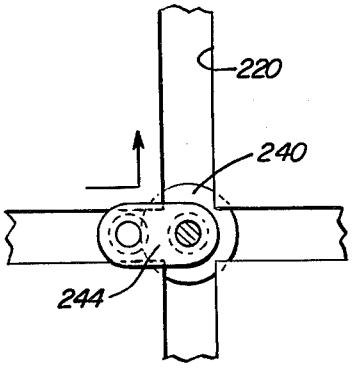
FIGS. 12-14 are schematic plan views illustrating progressively the negotiation of the carrier illustrated in FIGS. 9-11 around a right angle turn or intersection in a track grid system.
Figure 13:
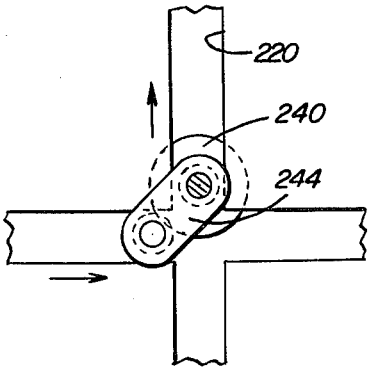
Figure 14:
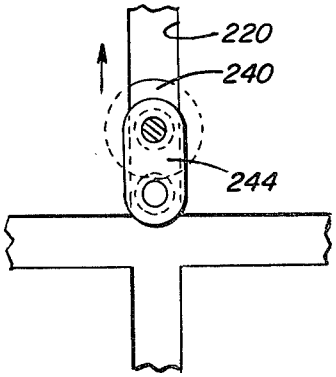
Figure 15:
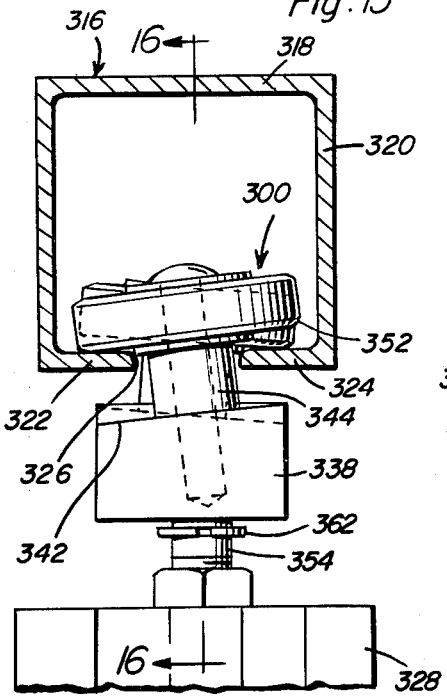
FIG. 15 is a transverse, sectional view of a channel-shaped track illustrating, in elevation, a tandem wheel carrier in which the wheels are canted in opposite directions with a peripheral lower axial portion of one wheel engaging one track flange and a peripheral axial portion of the other wheel engaging the other track flange.

Extending through the connector bushing 222 is a supporting member in the form of a bolt 252 having a polygonal head 254 received in a recess 256 in the upper end of the tilt body 224. A thrust bearing assembly 258 is disposed between the bottom end of the recess 256 and the bolt head 254 to rotatably support the bolt 252 in relation to the connector bushing 222. A split spring ring 260 is provided on the bolt 252 below the plate 244 to retain the plate 244 assembled onto the connector bushing. The lower end of the bolt 252 is provided with a threaded or other connection 262 to a wall module or panel 264 with a retaining nut 266 on the threaded portion 262. The portion of the connector bushing extending through the plate 244 may be polygonal as is the portion of the bushing extending through the tilt body 224 to prevent relative rotation between these components. Thus, the tilt body 224 will be maintained in predetermined rotatable relation to the track 202, that is, one peripheral axial portion of the wheel defined by the cap and thrust bearing engages only the upper surface of the track flange 214 as illustrated in FIG. 9, thereby reducing friction and wear and facilitating negotiation of right angle turns as illustrated in FIGS. 12–14 with the direction of force and movement exerted on the carrier being illustrated progressively in FIGS. 11–14 with the canted wheel leading the trailing plate with the roller 250 assuring that the canted wheel will be maintained in predetermined orientation in relation to the track during its movement. Directional arrows are provided on FIGS. 12–14 indicating the direction of travel of the canted wheel and trailing plate with roller thereon.

FIGS. 15–19 illustrate an embodiment of the canted wheel carrier 300 which is illustrated in association with a track 316 having a top wall 318 and depending side walls 320 terminating in inwardly extending flanges 322 and 324 having spaced inner edges defining a track slot 326. The carrier 300 includes a pair of tandemly arranged wheels 330 and 332 which are rotatably journaled on an inclined axle or spindle 334 and 336 which may be in the form of a shoulder bolt or fastener screw threaded into a longitudinally extending carrier block 338 supported below the track flanges 322 and 324 with the upper surface of the block 338 including two oppositely inclined surfaces 340 and 342 for forming an abutment surface for the shoulder bolts 334 and 336 and also provide a surface in engagement with a roller 344 journaled on each of the axles defined by the shoulder bolts 334 and 336 with the roller 344 being oriented within the track slot 326. Each of the axles defined by the shoulder bolts 334 and 336 is provided with a kerf 346 for receiving a screw driver blade or the like or these bolts may be provided with polygonal heads for receiving a suitable wrench or the like. Each wheel 330 and 332 is provided with a bearing 348 which journals the wheel from the respective axle. The bearing 348 may be in the form of a bushing having thrust plates 350 associated therewith or a ball bearing, roller bearing, or the like, which enables rotation of the wheels 330 and 332 with minimum frictional resistance. Each wheel 330 and 332 is of cylindrical configuration with the outer peripheral corners thereof chamfered as at 352. The diameter of the wheels is at least twice the width of the track slot. The lower portion of the peripheral axial surface of the wheel 330 is in rolling, axial contact with the upper surface of the flange 322 so that as the carrier 300 moves longitudinally along the track 316, the wheel 330 will rotate in one direction. At the same time, the other wheel 332 has a peripheral, axial side portion engaged with the upper surface of the track flange 324 so that it will rotate in the opposite rotational direction as compared with the wheel 330, thereby reducing any frictional drag which would be caused by diametrically opposed axial surfaces of the same roller engaging both track flanges. In addition to reducing friction and wear, the spaced contact between the wheels and track flanges provides longitudinal stability due to the longitudinal spacing of the contact areas as well as lateral stability due to the lateral spacing of the points of contact. The track flanges 322 and 324 may be slightly inclined inwardly and upwardly to an angle less than the angle of inclination of the rotational axis of the wheel. The angle of inclination of the wheels relative to the vertical is between 5 and 15 degrees while the angle of the track surfaces is several degrees less.

Figure 16:
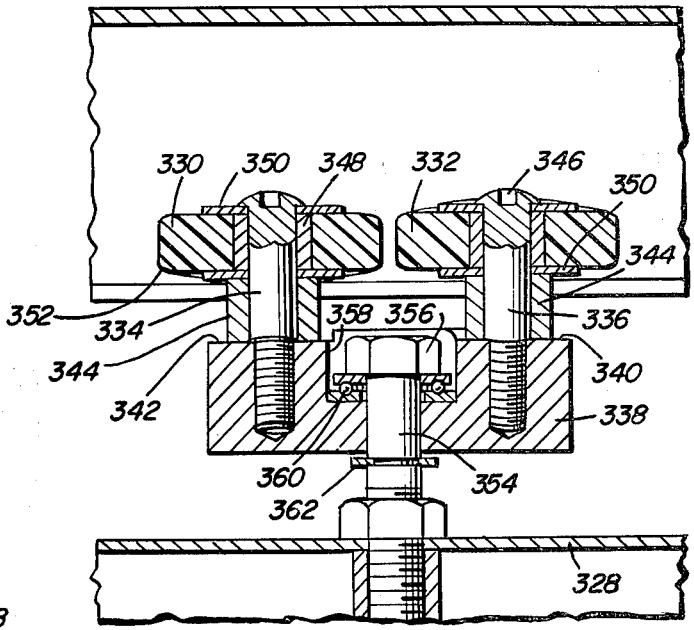
FIG. 16 is a longitudinal, sectional view taken taken substantially upon a plane passing along section line 16—16 of FIG. 15 illustrating further structural details of the tandem canted wheel carrier.

As illustrated in FIG. 16, the longitudinal supporting block 338 is provided with a centrally disposed supporting spindle, bolt, or the like, 354 screw threaded or otherwise secured to the panel 328 with the polygonal head 356 of the bolt being received in a recess 358 in the block 338 and a thrust bearing 360 is provided between the bolt head 356 and the bottom of the bore 358 to facilitate relative rotation between the supporting bolt 354 and the block 338. Various types of thrust washers, ball-type thrust bearings, or the like, may be employed to reduce rotational friction between the supporting block 338 and the bolt 354. A spring ring 362 may be provided on the bolt 354 to maintain the block 338 in assembled relation on the bolt 354.

Figure 17:
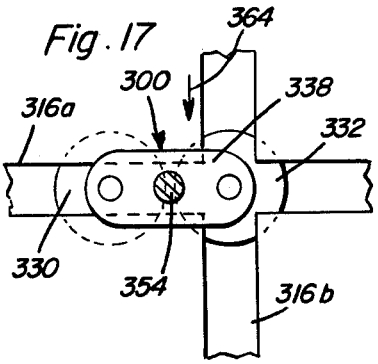
FIGS. 17-19 are schematic plan views illustrating the manner in which the tandem, canted wheel carrier illustrated in FIGS. 15-16 negotiates a right angle turn or intersection in a track grid system.
Figure 18:
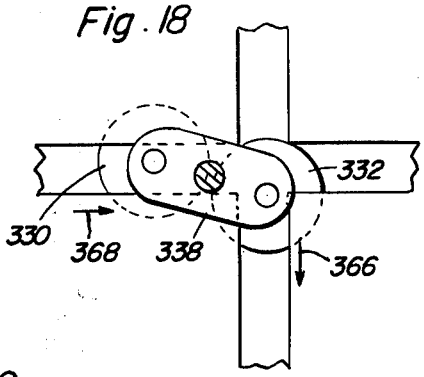
Figure 19:
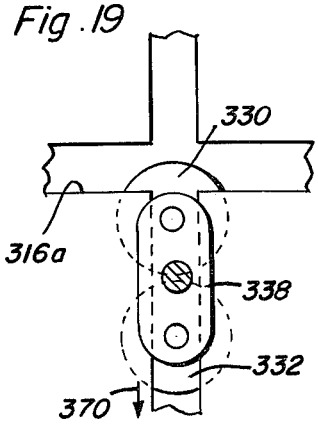

FIGS. 17–19 illustrate progressively the movement of the canted wheel carrier 300 from a segment of track **316*a* to a segment of track 316*b* which are perpendicular to each other. As the lead wheel 332 comes into alignment with the intersection between the track segments, a lateral force is exerted in the direction of the arrow 364 with the force being applied to the panel 328 adjacent the edge portion thereof which is nearest the intersection of the track segments. As the lateral force is exerted, the lead wheel 332 will move into the track segment 316*b* as indicated by the arrow 366 in FIG. 18 while the trailing wheel 330 continues to move in the direction of the arrow 368 in FIG. 18 into a position aligned with the track segment 316*b* and as illustrated in FIG. 19, when the trailing wheel 330 becomes aligned with the track segment 316*b*, the entire carrier is then moved in the direction of the arrow 370 illustrated in FIG. 19. Thus, carriers 300 supporting a panel 328** are easily maneuvered around a right angle turn or perpendicular intersection in any track system without the use of curved track sections or without tracks switches, and the like.

Figure 20:
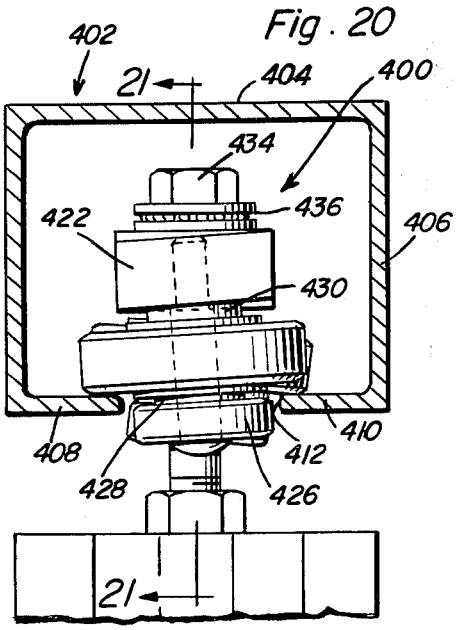
FIG. 20 is a transverse, sectional view, similar to FIG. 15, in which the tandem, canted wheel carrier includes a connecting element between the two wheels oriented interiorly of the track rather than below the track flanges.
Figure 21:
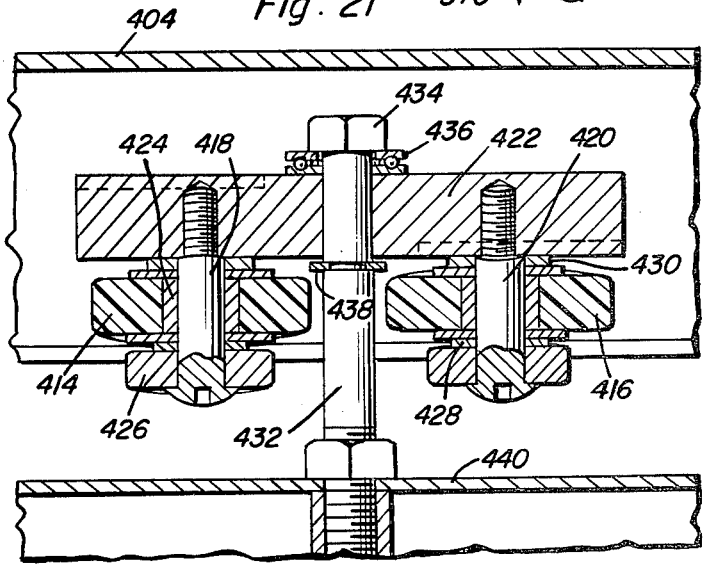
FIG. 21 is a longitudinal, sectional view taken substantially upon a plane passing along section line 21—21 of FIG. 20 illustrating further structural details of this embodiment of the invention.

Referring now specifically to FIGS. 20 and 21 of the drawings, a slightly different version of the tandem canted wheel carrier is disclosed and generally designated by numeral 400 for movement along a track 402 which includes an upper web 404, side walls 406 and inwardly extending flanges 408 and 410 defining a track slot 412. In this embodiment, the carrier 400 includes a pair of tandemly arranged wheels 414 and 416 which are rotatably journaled on an inclined axle or spindle 418 and 420 which are in the form of a shoulder bolt or fastener device threaded into a longitudinally extending carrier block 422 which is disposed interiorly of the track 402 rather than longitudinally below the track as illustrated in FIGS. 15–19. The axle bolts 418 and 420 rotatably support the wheels 414 and 416 in oppositely canted direction with a suitable bearing structure 424 reducing the frictional resistance of the wheels 414 and 416. The headed lower end of each of the bolts 418 and 420 serves as a retainer for a roller 426 positioned in the track slot with a thrust washer 428 being provided between the roller 426 and the canted wheel and a similar thrust washer 430 is provided between the canted wheel and the adjacent inclined surface of the block 422. Various types of bearing structures and thrust bearings may be utilized to reduce the rotational friction of the canted wheels 414 and 416.

Centrally disposed through the block 422 is a support bolt 432 having the polygonal bolt head 434 engaged with a thrust bearing 436 on the top surface of the block 422. A spring ring 438 is provided to maintain the supporting bolt 432 in assembled relation to the block 422. The bolt 432 extends down through the track slot 412 and is screw threadedly or otherwise connected to a wall module or panel 440. The operation of this embodiment of the invention is the same as that illustrated in FIGS. 15–19 with the supporting block structure 422 being above the canted rollers 414 and 416 so that the top edge of the wall module or panel 440 may be disposed as close as possible to the undersurface of the track 402. The rollers 426 maintain the carrier 400 in generally centered relationship in relation to the track slot 412 and the canted wheels 414 and 416 operate in the same manner as the canted wheels in the carrier 300 in FIGS. 15–19.

Figure 22:
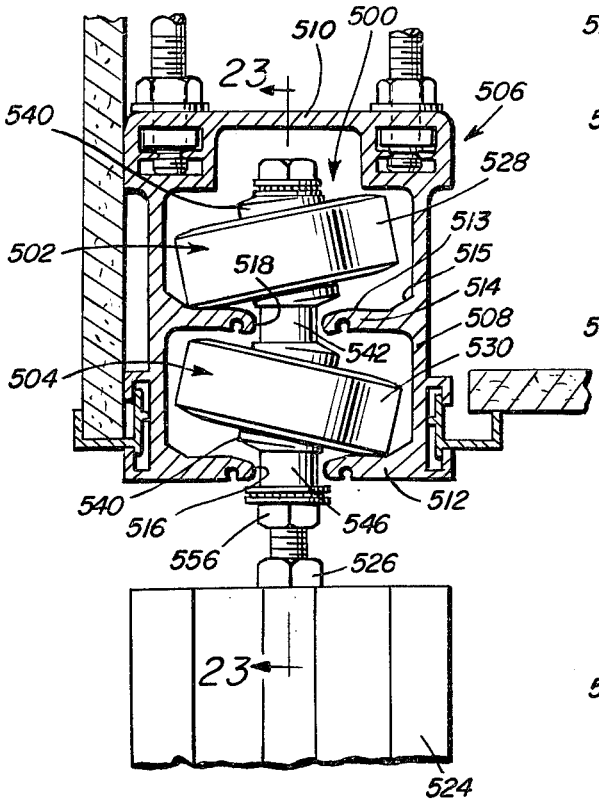
FIG. 22 is a transverse sectional view illustrating a carrier having two vertically stacked canted wheels which are canted in opposite directions and engage opposed vertically spaced flanges.
Figure 23:
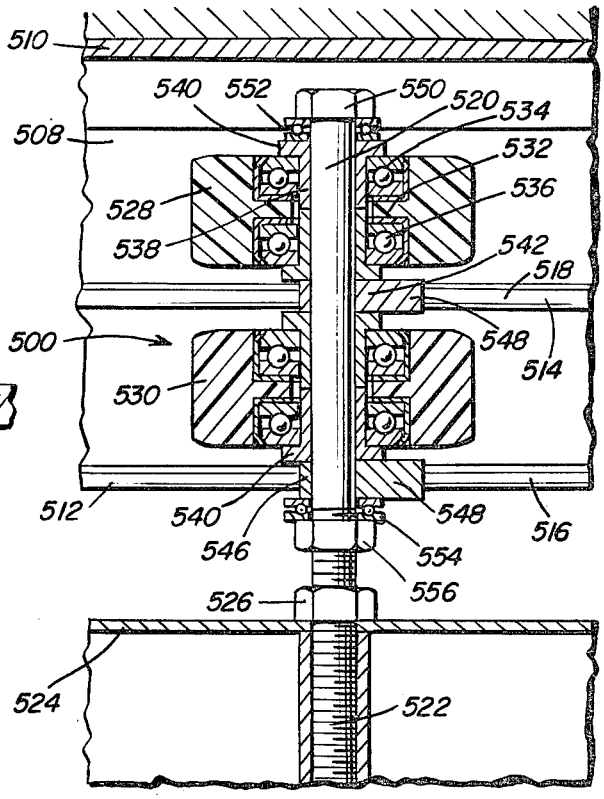
FIG. 23 is a longitudinal, sectional view taken substantially upon a plane passing along section line 23—23 of FIG. 22 illustrating further structural details of this embodiment of the invention.

FIGS. 22 and 23 illustrate an embodiment of the invention in which the carrier is generally designated by numeral 500 and includes a pair of canted wheels 502 and 504 which are oriented in vertically aligned, spaced relation in which the axes of rotation of the wheels 502 and 504 are oppositely inclined as illustrated in FIG. 22.

The track employed in this embodiment of the invention is generally channel shaped and designated by numeral 506 and includes a pair of generally vertically disposed parallel side walls 508 interconnected by a top wall 510. Each of the side walls 508 includes a pair of inwardly extending lower flanges 512 and inwardly extending intermediate flanges 514 with the flanges 512 terminating in spaced parallel edges defining a lower track slot 516 and the flanges 514 terminating in spaced parallel edges defining a track slot 518 with the track slots 516 and 518 being vertically aligned and the upper surfaces of the flanges 512 and 514 including an inclined upper surface portion 513 which inclines downwardly away from the track slot at approximately 3 degrees in relation to horizontal and an upwardly inclined curb 515 at the outer edge of the surface 513 which inclines at approximately 30 degrees in relation to horizontal.

The carrier 500 includes a vertically disposed bolt 520 having a threaded lower end 522 connected to a wall module or panel 524 by a screw threaded connection with a retaining and adjusting nut 526 being provided on the threaded portion 522 of the bolt. Each of the canted wheels 502 and 504 includes a roller 528 and 530 with each roller including an inwardly extending centrally disposed flange 532 defining upper and lower recesses for receiving thrust bearing assemblies 534 and 536. Each thrust bearing assembly is mounted on a pair of tilt bodies 538 each of which has an end flange 540 defining a shoulder which is slanted to orient the bearing assemblies and wheel in a transversely inclined position as illustrated in FIG. 22 so that an axial portion of the upper wheel 502 will engage one of the flanges 514. A spacer 542 is positioned between the two canted wheels 502 and 504 with the upper edge of the spacer engaging the flange 540 on the lower end of a tilt body 538 and the lower edge of the spacer 542 engaging the upper surface of the flange 540 on the upper end of tilt body 538 in the lower canted wheel 504 as illustrated in FIG. 23. A lower spacer 546 is mounted on the bolt 520 and includes an upper surface engaging a flange 540 on tilt body 538 in the lower canted wheel 504. Both spacers 542 and 546 include a laterally extending control arm 548 which is received in the respective track slots 516 and 518 in order to maintain proper orientation of the tilt bodies 538 as well as the spacers 542 and 546.

The bolt 520 includes a polygonal head 550 with a thrust bearing 552 between the head and the flange or shoulder 540 to facilitate relative rotation of the bolt and the tilt body assemblies. The lower end of the carrier includes a thrust bearing 554 and a nut 556 on the threaded portion 522 of the bolt which retains the tilt bodies, bearing assemblies and wheels in assembled relationship.

Figure 24:
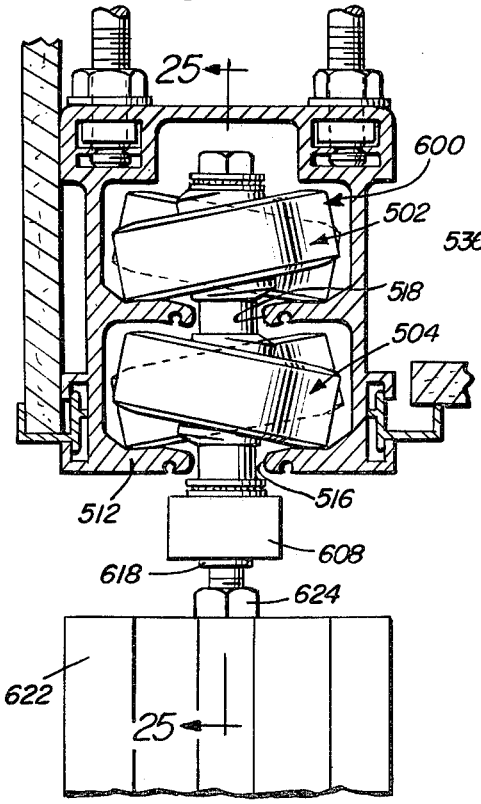
FIG. 24 is a transverse sectional view similar to FIG. 22 illustrating a carrier with tandemly arranged pairs of vertically stacked canted wheels.
Figure 25:
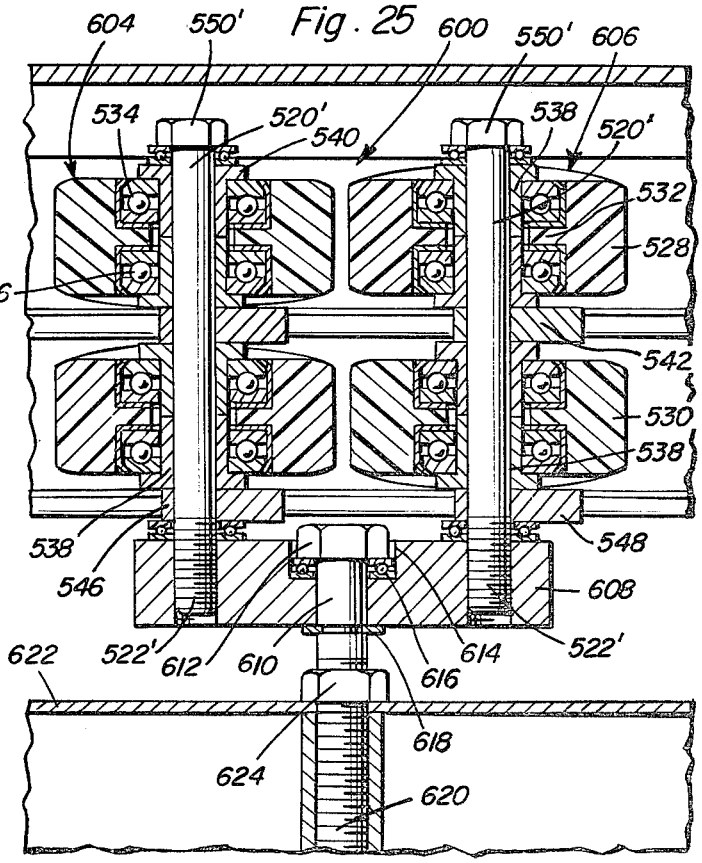
FIG. 25 is a longitudinal, sectional view taken substantially along section line 25—25 of FIG. 24 illustrating further structural details of this embodiment of the invention.

FIGS. 24 and 25 illustrate an embodiment of the carrier 600 which includes two pairs of vertically spaced and aligned canted wheels oriented in tandem relation. The track 602 is exactly the same as that illustrated in FIGS. 22 and 23 and the same reference numerals are applied thereto. In this embodiment of the invention, two tandemly arranged pairs of canted wheels 604 and 606 are disposed in the track 602 with each pair of wheels 604 and 606 being identical to the wheels 502 and 504 in FIGS. 22 and 23 with the same reference numerals being applied thereto. In this embodiment of the invention, the bolts 520′ are each shorter than the bolt 520 and terminate in a lower threaded end portion 522′ which are threaded into threaded openings in a connector block 608 which extends parallel to the track 602 below the lower track slot 516 in order to maintain the two bolts 520′ in parallel and rigid relationship. The tandem connecting block 608 is provided with a supporting bolt 610 extending centrally therethrough with the upper end of the bolt 610 including a head 612 received in a recess 614 in the block with a thrust bearing 616 disposed between the head 612 and the bottom of the recess 614. A spring ring 618 is mounted on the bolt in engagement with the lower end of the block 608 for retaining the bolt in assembled relation thereto. The lower end of the bolt 610 is threaded as indicated by numeral 620 and is connected to a wall panel 622 with an adjusting and retaining nut 624 being provided for retaining the wall panel 622 in adjusted position.

The embodiment of the vertically spaced and aligned canted wheels in FIGS. 22 and 23 provides lateral stability by virtue of the two canted wheels 502 and 504 engaging flanges 512 and 514 on opposite sides of the load supported by the bolt 520. In the embodiment illustrated in FIGS. 24 and 25, in addition to the lateral stability provided by the vertically spaced, oppositely canted wheels, the tandemly arranged pairs of wheels in which the wheels in the pair of wheels 606 are oppositely canted in relation to the wheels in the pair 604 provides longitudinal stability to the carrier 600 by engaging the track flanges at longitudinally spaced points. In addition, the oppositely canted wheels in the adjacent vertical pairs provides additional lateral stability to the carrier. The additional wheels in FIGS. 24 and 25 also provide additional load carrying capacity when using the same track and carrier components. In the four-wheel embodiment, at least one of the wheels should be canted in an opposite direction to the others.

The various embodiments of the canted wheel provide a rotational axis which is inclined in relation to both vertical and horizontal with the angle of inclination of the rotational axis being substantially smaller in relation to vertical than in relation to horizontal. It has been found that best results are obtained when the angle of inclination of the rotational axis relative to vertical is on the order of 5 to 15 degrees.

Also, each of the embodiments of the invention may include an inclination of the supporting surface whether it be a top or bottom trackway or other supporting surface in which the supporting surface is inclined in the same direction in relation to vertical and horizontal as the rotational axis of the canted wheel, but the angle of inclination relative to horizontal is to a substantially lesser degree than the inclination of the rotational axis of the canted wheel in relation to vertical. Also, all of the embodiments of the invention include the canted wheel or wheels which have a portion of their peripheral axial surface rollingly engaging a supporting surface with a diametrically opposite peripheral axial surface being spaced from the supporting surface thereby materially reducing friction and enabling longitudinal movement of the carrier or carriers in relation to the supporting surface or surfaces and also facilitating negotiation of angle turns or intersections in the supporting surface.

The inclined track flanges or supporting surfaces, especially when used in the vertically spaced wheel carrier arrangements such as shown in FIGS. 22–25, provide a centering of the carrier in relation to the track slot and when used with a single wheel embodiment, it will retain the guide roller in the track slot in contact with the edge of the track flange. Also, a laterally arranged tandem may be used in which oppositely canted wheels engage the track flanges and a transverse connecting block extends across the track slot interiorly of the track.

The wall modules may be supported by various numbers of carriers per panel and the tilt body structure can be associated with, secured to or otherwise connected to the wall panel rather than with the carrier or wheels. Also, the bearing structure provided to enable relative rotation and transfer load may be any conventional bearing structure which may be permanently lubricated and sealed or provided with any suitable lubrication facilities.

Also, the carrier with supporting wheel or wheels may be used with straight track segments, various angle turns and intersections as shown in FIGS. 1–4 and with various panel stacking arrangements, two possible arrangements being shown in FIGS. 1 and 2. Also, the carrier can be used with accordion folded partitions, hinged pairs of panels, continuously hinged panels and with dual accordion folded doors as well as to support various panels in desired locations, such as chalk board in relation to a single or dual accordion folding wall. The panels are preferably provided with flexible seal strips or other sealing means at their upper and lower edges for sound deadening purposes.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A canted wheel carrier for movably supporting wall panels from a supporting surface, said carrier including a canted wheel having a rotational axis inclined in relation to vertical and horizontal, the angle of inclination of said rotational axis being smaller in relation to vertical than in relation to horizontal whereby a portion of the peripheral axial surface of the canted wheel is rollingly engaged with the supporting surface and the diametrically opposite portion of the wheel is spaced from the supporting surface, said carrier including support means connected with a panel.

2. The structure as defined in claim 1, wherein said supporting surface is in the form of a track including spaced track flanges defining a track slot and said support means extends through said track slot.

3. The structure as defined in claim 2, wherein said support means includes a guide member thereon for guiding engagement with the edge of a track flange.

4. The structure as defined in claim 1, wherein said carrier includes a tilt body having said wheel rotatably mounted thereon and said support means connects said tilt body with said panel.

5. The structure as defined in claim 2, wherein said carrier includes a tilt body having said wheel rotatably mounted thereon, said support means connects said tilt body with said panel, said tilt body is rotatable relative to said panel, and a longitudinally extending control arm is connected to said tilt body such that the control arm and tilt body are non-rotatable in relation to each other, the control arm including a portion disposed in the track slot for maintaining said tilt body and said inclined rotational axis in correct orientation to the direction of travel of the carrier to facilitate negotiation of angle turns in the track.

6. The structure as defined in claim 2, wherein the diameter of said canted wheel is greater than two times the width of said track slot.

7. The structure as defined in claim 1, wherein said supporting surface is disposed above said wall panels and said support means is connected with the top of said panel.

8. The structure as defined in claim 7, wherein the bottom of said panel has associated therewith a guide means engaged with a bottom guideway.

9. The structure as defined in claim 1, wherein said supporting surface is disposed below said wall panels and said support means is connected with the bottom of said panel.

10. The structure as defined in claim 9, wherein the top of said panel has associated therewith a guide means engaged with an overhead guideway.

11. The structure as defined in claim 1, wherein said angle of inclination relative to vertical is quite small, on the order of five to fifteen degrees.

12. The structure as defined in claim 1, wherein said supporting surface is horizontal.

13. A canted wheel carrier for movably supporting wall panels from a supporting surface, said carrier including a canted wheel having a rotational axis inclined in relation to vertical and horizontal, whereby a portion of the peripheral axial surface of the canted wheel is rollingly engaged with the supporting surface and the diametrically opposite portion of the wheel is spaced from the supporting surface, said carrier including support means connected with a panel, said supporting surface being inclined in the same direction as is said axis of rotation but the angle of inclination of said supporting surface relative to horizontal is of lesser degree than the angle of inclination of said rotational axis relative to vertical.

14. A canted wheel carrier for movably supporting wall panels from a supporting surface, said carrier including a canted wheel having a rotational axis inclined in relation to vertical and horizontal, whereby a portion of the peripheral axial surface of the canted wheel is rollingly engaged with the supporting surface and the diametrically opposite portion of the wheel is spaced from the supporting surface, said carrier including support means connected with a panel, said supporting surface forming a portion of a trackway, a trackway side wall element is connected to said supporting surface, and a portion of the rim of said canted wheel rollingly engages said trackway side wall element for positioning and guiding of said canted wheel carrier during longitudinal movement along said trackway.

15. The structure as defined in claim 14, wherein said trackway sidewall element is in the form of an inclined curb.

16. A canted wheel carrier for movably supporting wall panels from a supporting surface, said carrier including a canted wheel having a rotational axis inclined in relation to vertical and horizontal, whereby a portion of the peripheral axial surface of the canted wheel is rollingly engaged with the supporting surface and the diametrically opposite portion of the wheel is spaced from the supporting surface, said carrier including support means connected with a panel, said canted wheel including a bearing and a lower peripheral edge and lower peripheral axial surface for engagement with the supporting surface with the diametrically opposite portion being spaced from the supporting surface, said lower peripheral edge and lower peripheral axial surface being constructed of plastic or other material to minimize wear and facilitate rolling movement of the lower peripheral axial surface of the canted wheel in relation to the supporting surface.

17. The structure as defined in claim 1, wherein said panel includes seal means at its upper and lower edges for sound deadening purposes.

18. A canted wheel carrier for movably supporting wall panels from a supporting surface, said carrier including a canted wheel having a rotational axis inclined in relation to vertical and horizontal, whereby a portion of the peripheral axial surface of the canted wheel is rollingly engaged with the supporting surface and the diametrically opposite portion of the wheel is spaced from the supporting surface, said carrier including support means connected with a panel, said carrier including a second canted wheel spaced horizontally and laterally from the first canted wheel, said first and second wheels being canted in opposite directions thereby providing laterally spaced points of engagement with the supporting surface and whereby the canted wheels rotate in opposite directions during longitudinal movement of the carrier in relation to the supporting surface.

19. A canted wheel carrier for movably supporting wall panels from a supporting surface, said carrier including a canted wheel having a rotational axis inclined in relation to vertical and horizontal, whereby a portion of the peripheral axial surface of the canted wheel is rollingly engaged with the supporting surface and the diametrically opposite portion of the wheel is spaced from the supporting surface, said carrier including support means connected with a panel, said carrier including a second canted wheel spaced horizontally and longitudinally from the first canted wheel, said first and second wheels being canted in opposite directions thereby providing longitudinally and laterally spaced points of engagement with the supporting surface and whereby the canted wheels rotate in opposite directions during longitudinal movement of the carrier in relation to the supporting surface.

20. The structure as defined in claim 19, wherein said supporting surface is in the form of a generally channel-shaped track including spaced track flanges defining a track slot and said first and second canted wheels are mounted on a longitudinally extending mounting block disposed exteriorly of said track with the means connecting said mounting block to each of said canted wheels extending through said track slot.

21. The structure as defined in claim 20, wherein each of said connecting means includes a guide member for guiding engagement with the edge of a track flange.

22. The structure as defined in claim 19, wherein said supporting surface is in the form of a generally channel-shaped track including spaced track flanges defining a track slot and said first and second canted wheels are mounted on a longitudinally extending mounting block disposed interiorly of said track with the means connecting said block to said panel extending through said track slot.

23. The structure as defined in claim 22, wherein the connecting means between said mounting block and each of said canted wheels extends into said track slot and includes a guide member for guiding engagement with the edge of a track flange.

24. A canted wheel carrier for movably supporting wall panels from a supporting surface, said carrier including a canted wheel having a rotational axis inclined in relation to vertical and horizontal, whereby a portion of the peripheral axial surface of the canted wheel is rollingly engaged with the supporting surface and the diametrically opposite portion of the wheel is spaced from the supporting surface, said carrier including support means connected with a panel, said carrier including a second canted wheel spaced vertically from the first canted wheel and engaging a second supporting surface, said first and second wheels being canted in opposite directions thereby providing vertically and laterally spaced points of engagement with the supporting surfaces and whereby the canted wheels rotate in opposite directions during longitudinal movement of the carrier in relation to the supporting surfaces.

25. The structure as defined in claim 24, wherein each of said supporting surfaces consists of a pair of spaced track flanges defining a track slot, the upper surface of each track flange is inclined downward away from said track slot, and the lower edge of each said inclined upper surface is connected to an oppositely inclined track curb, so that each of said canted wheels tends to move toward the point of connection between said inclined upper surface and said inclined curb thereby positioning and centering said carrier relative to said track slots.

26. The structure as defined in claim 24, wherein each of said supporting surfaces consists of a pair of spaced track flanges defining a track slot, each of said canted wheels is rotatably mounted on a tilt body, and said tilt bodies are mounted on a common support shaft which extends through said track slots.

27. The structure as defined in claim 26, including at least one longitudinally extending control arm disposed in a track slot and rigid with said tilt bodies for maintaining the tilt bodies and the inclined rotational axes in correct orientation to the direction of travel of the carrier to facilitate negotiation of angle turns in the track.

28. A canted wheel carrier for movably supporting wall panels from a supporting surface, said carrier including a canted wheel having a rotational axis inclined in relation to vertical and horizontal, whereby a portion of the peripheral axial surface of the canted wheel is rollingly engaged with the supporting surface and the diametrically opposite portion of the wheel is spaced from the supporting surface, said carrier including support means connected with a panel, said carrier including a second canted wheel spaced horizontally and longitudinally from the first canted wheel, and third and fourth canted wheels spaced horizontally and longitudinally from each other and vertically from said first and second canted wheels and engaging a second supporting surface, and wherein at least one of the four wheels is canted in a direction opposite to the other wheels thereby providing vertically, longitudinally and laterally spaced points of engagement with the supporting surfaces and whereby the oppositely canted wheels will rotate in opposite directions during longitudinal movement of the carrier in relation to the supporting surfaces.

29. A multi-directional canted wheel carrier for wall modules comprising a pair of tandemly and laterally arranged canted wheels interconnected by a mounting member, said canted wheels being canted in opposite directions for engagement with laterally spaced points on a track, support means connected to the carrier for supporting engagement with a wall module whereby the canted wheels will rotate in opposite directions during longitudinal movement of the carrier in relation to the track to reduce frictional resistance to movement of the wall module and facilitate negotiation of an angle turn in the track without the use of track switches, curved track segments, and the like.

30. A multi-directional canted wheel carrier for wall modules comprising a pair of tandemly and longitudinally arranged canted wheels interconnected by a mounting member, said canted wheels being canted in opposite directions for engagement with laterally and longitudinally spaced points on a track, support means connected to the carrier for supporting engagement with a wall module whereby the canted wheels will rotate in opposite directions during longitudinal movement of the carrier in relation to the track to reduce frictional resistance to movement of the wall module and facilitate negotiation of an angle turn in the track without the use of track switches, curved track segments, and the like.

31. A multi-directional canted wheel carrier for wall modules comprising a pair of vertically spaced canted wheels, said canted wheels being canted in opposite directions for engagement with vertically and laterally spaced points on a track, support means connected to the carrier for supporting engagement with a wall module whereby the canted wheels will rotate in opposite directions during longitudinal movement of the carrier in relation to the track to reduce frictional resistance to movement of the wall module and facilitate negotiation of an angle turn in the track without the use of track switches, curved track segments, and the like.

32. A multi-directional canted wheel carrier for wall modules comprising two pair of vertically spaced canted wheels, said pairs being tandemly arranged with each other and interconnected by a mounting member, and at least one of the four canted wheels being canted in a direction opposite to the other wheels for engagement with vertically, longitudinally and laterally spaced points on a track, support means connected to the carrier for supporting engagement with a wall module whereby the oppositely canted wheels will rotate in opposite directions during longitudinal movement of the carrier in relation to the track to reduce frictional resistance to movement of the wall module and facilitate negotiation of an angle turn in the track without the use of track switches, curved track segments, and the like.

* * * * *